US010827842B1

(12) United States Patent
Jarnes

(10) Patent No.: US 10,827,842 B1
(45) Date of Patent: Nov. 10, 2020

(54) SEAT MODULE

(71) Applicant: Ekornes ASA, Ikornnes (NO)

(72) Inventor: Webjørn Jarnes, Ikornnes (NO)

(73) Assignee: Ekornes ASA, Ikornnes (NO)

( * ) Notice: Subject to any disclaimer, the term of this patent is extended or adjusted under 35 U.S.C. 154(b) by 0 days.

(21) Appl. No.: 16/756,791

(22) PCT Filed: Oct. 22, 2018

(86) PCT No.: PCT/NO2018/050252

§ 371 (c)(1),
(2) Date: Apr. 16, 2020

(87) PCT Pub. No.: WO2019/078731

PCT Pub. Date: Apr. 25, 2019

(30) Foreign Application Priority Data

Oct. 20, 2017 (NO) ..... 20171689

(51) Int. Cl.
*A47C 7/56* (2006.01)
*A47C 7/44* (2006.01)
*A47C 1/032* (2006.01)

(52) U.S. Cl.
CPC ..... *A47C 7/566* (2013.01); *A47C 1/03294* (2013.01); *A47C 7/44* (2013.01)

(58) Field of Classification Search
CPC ..... A47C 1/03294; A47C 7/44; A47C 7/445; A47C 7/4454; A47C 7/448; A47C 7/566; A47C 1/03261; A47C 1/03277; A47C 1/03279; A47C 1/03288
See application file for complete search history.

(56) References Cited

U.S. PATENT DOCUMENTS 2,470,364 A 5/1949 Niederhauser
3,363,942 A * 1/1968 Fletcher ..... A47C 1/0352 297/322

(Continued)

FOREIGN PATENT DOCUMENTS

CA 2368211 8/2001
CH 681772 5/1993

(Continued)

OTHER PUBLICATIONS

Patent Cooperation Treaty, "International Search Report and Written Opinion," issued in connection with PCT Patent Application No. PCT/NO2018/050252, dated Jan. 18, 2019, 8 pages.

(Continued)

*Primary Examiner* — Milton Nelson, Jr.
(74) *Attorney, Agent, or Firm* — Hanley, Flight & Zimmerman, LLC

(57) ABSTRACT

There is described a seat module for use in furniture for sitting, the seat module comprising a backrest (1) and a seat (2) and a coupling element (3), the backrest (1) being adapted to run along rear grooves (7) arranged in respective sides of the coupling element at its rear edge, a rear portion of the seat (2) is connected to the backrest (1) and a front portion of the seat (2) is adapted to run along front grooves (9) arranged in respective sides of the coupling element in its leading edge. The seat module further comprises a tilting mechanism (15-19) connecting the coupling element with a support member or base (4).

2 Claims, 5 Drawing Sheets

(56) References Cited

U.S. PATENT DOCUMENTS

| | | | | | |
|---|---|---|---|---|---|
| 3,572,829 | A * | 3/1971 | Malitte | B64D 11/064 297/317 |
| 4,183,494 | A | 1/1980 | Cleveland | |
| 4,915,446 | A * | 4/1990 | Darling | B60N 2/2821 297/256.13 |
| 5,197,781 | A | 3/1993 | Tada | |
| 5,397,165 | A | 3/1995 | Grin et al. | |
| 5,735,574 | A * | 4/1998 | Serber | B60N 2/4221 297/216.1 |
| 5,785,384 | A * | 7/1998 | Sagstuen | A47C 1/032 297/317 |
| 6,568,755 | B1 * | 5/2003 | Groening | B60N 2/2821 297/256.1 |
| 6,641,214 | B2 * | 11/2003 | Veneruso | B64D 11/064 297/322 |
| 8,485,604 | B2 | 7/2013 | Pfeifer et al. | |
| 9,241,571 | B2 * | 1/2016 | Robertson | A47C 1/035 |
| 2002/0109384 | A1 | 8/2002 | Hansen | |
| 2003/0071502 | A1 | 4/2003 | Marshall et al. | |
| 2009/0261642 | A1 | 10/2009 | Dickie | |
| 2018/0289167 | A1 | 10/2018 | Tedesco | |
| 2020/0237095 | A1 | 7/2020 | Jarnes | |

FOREIGN PATENT DOCUMENTS

| | | | | |
|---|---|---|---|---|
| DE | 3033953 | A1 * | 5/1981 | A47C 1/03294 |
| DE | 9311345 | U1 * | 9/1993 | A47C 1/03238 |
| DE | 102005033052 | | 2/2007 | |
| DE | 202015103255 | | 8/2015 | |
| EP | 0559185 | | 9/1993 | |
| EP | 1230876 | | 8/2002 | |
| EP | 1 992 255 | | 11/2008 | |
| EP | 2725942 | | 5/2014 | |
| EP | 3556252 | | 10/2019 | |
| ES | 2347636 | | 11/2010 | |
| GB | 15751 | | 4/1914 | |
| GB | 794138 | A * | 4/1958 | A47C 1/032 |
| GB | 840195 | A * | 7/1960 | A47C 1/03294 |
| JP | 2007054152 | | 3/2007 | |
| WO | 2012177142 | | 12/2012 | |
| WO | 2013149646 | | 10/2013 | |
| WO | 2015167205 | | 11/2015 | |

OTHER PUBLICATIONS

Norwegian Patent Office, "Search Report," issued in connection with Norwegian Patent Application No. 20171689, dated May 16, 2018, 2 pages.

Patent Cooperation Treaty, "International Preliminary Report on Patentability," issued in connection with PCT Patent Application No. PCT/NO2018/050252, dated Feb. 3, 2020, 9 pages.

Patent Cooperation Treaty, "International Search Report and Written Opinion," issued in connection with PCT Patent Application No. PCT/NO2018/050250, dated Jan. 18, 2019, 10 pages.

Patent Cooperation Treaty, "International Preliminary Report on Patentability," issued in connection with PCT Patent Application No. PCT/N02018/050250, dated Feb. 3, 2020, 10 pages.

United States Patent and Trademark Office, Non-final Office Action, issued in connection with U.S. Appl. No. 16/756,788 dated May 18, 2020, 8 pages.

United States Patent and Trademark Office, Final Office Action, issued in connection with U.S. Appl. No. 16/756,788 dated Aug. 27, 2020, 7 pages.

* cited by examiner

SEAT MODULE

This patent is a US national stage application of International Patent Application No. PCT/NO2018/050252 which was filed on Oct. 22, 2018 under the Patent Cooperation Treaty (PCT), which claims priority to Norwegian Patent Application No. 20171689 which was filed on Oct. 20, 2017, all of the foregoing applications are hereby incorporated herein by reference in their entireties.

FIELD OF THE INVENTION

The present invention relates to furniture for sitting, and more particularly to a seat module that can be used in a chair or where several modules can be assembled to form a seating row, as well as a tilting mechanism that is particularly suitable for use in such a seat module.

BACKGROUND

So-called recliners are usually fitted with a control mechanism so that the angle of the backrest can be varied. The seat and backrest are usually hinged together while the backrest is pivotally attached to the armrests on each side. The user can then vary the angle of the backrest by pushing the body back and forth.

From Norwegian Patent 335401 it is known furniture for sitting where the position of the backrest and seat can be set in the same manner as in the recliners mentioned above. Here, however, the entire mechanism is hidden under the seat. A virtual turning point is established for the backrest so that the backrest does not have to be fixed to the armrests. The solution can therefore also be used in chairs without armrests, such as dining chairs.

There are also known office chairs where the backrest angle can be varied by turning a wheel or by operating a lever that unlock the backrest. With this solution, however, the backrest cannot be adjusted continuously as in the previous examples, as the backrest will return to the locked position when the user has finished the regulation. Such chairs may also have a tilt function that allows the backrest and seat to be tilted as a unit. This feature can also be locked.

SUMMARY OF THE INVENTION

It is an object of the present invention to provide a seat module for use in furniture for sitting that is designed for rational production and can be used in several different items of furniture such as chairs and sofas or for interconnecting multiple seats in a row.

This is achieved with a seat module as set forth in the appended claims.

In particular, the present invention includes a seat module for use in furniture for sitting, the seat module comprising a backrest, seat and coupling element, the coupling element comprising two side walls held together by transverse elements and further comprising rear grooves arranged in a rear end of the coupling element and front grooves arranged at a forward end of the coupling element, the rear and front grooves being arranged in respective sidewalls of the coupling element, wherein the backrest comprises brackets adapted to engage and run in said rear grooves, wherein a rear portion of the seat is connected to the backrest, and wherein a front portion of the seat is connected to a sliding unit running in said front grooves. The coupling element comprises through-openings located in the rear grooves the seat module further comprising a locking rod adapted to pass through holes in the brackets and through said openings so that the backrest is locked to the coupling element, the sliding unit comprises a slide rod with sliding sleeves at each end, the sliding sleeves being adapted to engage said front grooves, a spring is provided between a transverse element in the coupling element and said slide rod, and wherein the seat comprises rear notches adapted to grip the locking rod and front notches adapted to grip the slide rod.

This arrangement simplifies the mounting of the backrest on the coupling element and will also greatly simplify the assembly of the seat module as the seat merely snaps into place on the coupling element. The spring has two functions as it ensures optimal balance in the sliding function and straightens the backrest when the user leaves the seat module. In case the seat module is used in a number of chairs that stand around a table or as elements in a sofa, the automatic rearrangement of the backrest will ensure that the furniture always gives a clean impression.

According to a preferred embodiment of the invention the seat module includes rear grooves provided as arcuate or radial incisions, said brackets comprising corresponding arcuate or radial protrusions adapted to engage the grooves of the coupling element, and wherein the front grooves are provided as radial or arcuate or linear through grooves with a pitch toward the front of the seat module.

BRIEF DESCRIPTION OF THE DRAWINGS

The invention will now be described in detail with reference to the accompanying drawings, in which.

DETAILED DESCRIPTION

Figure 1A:
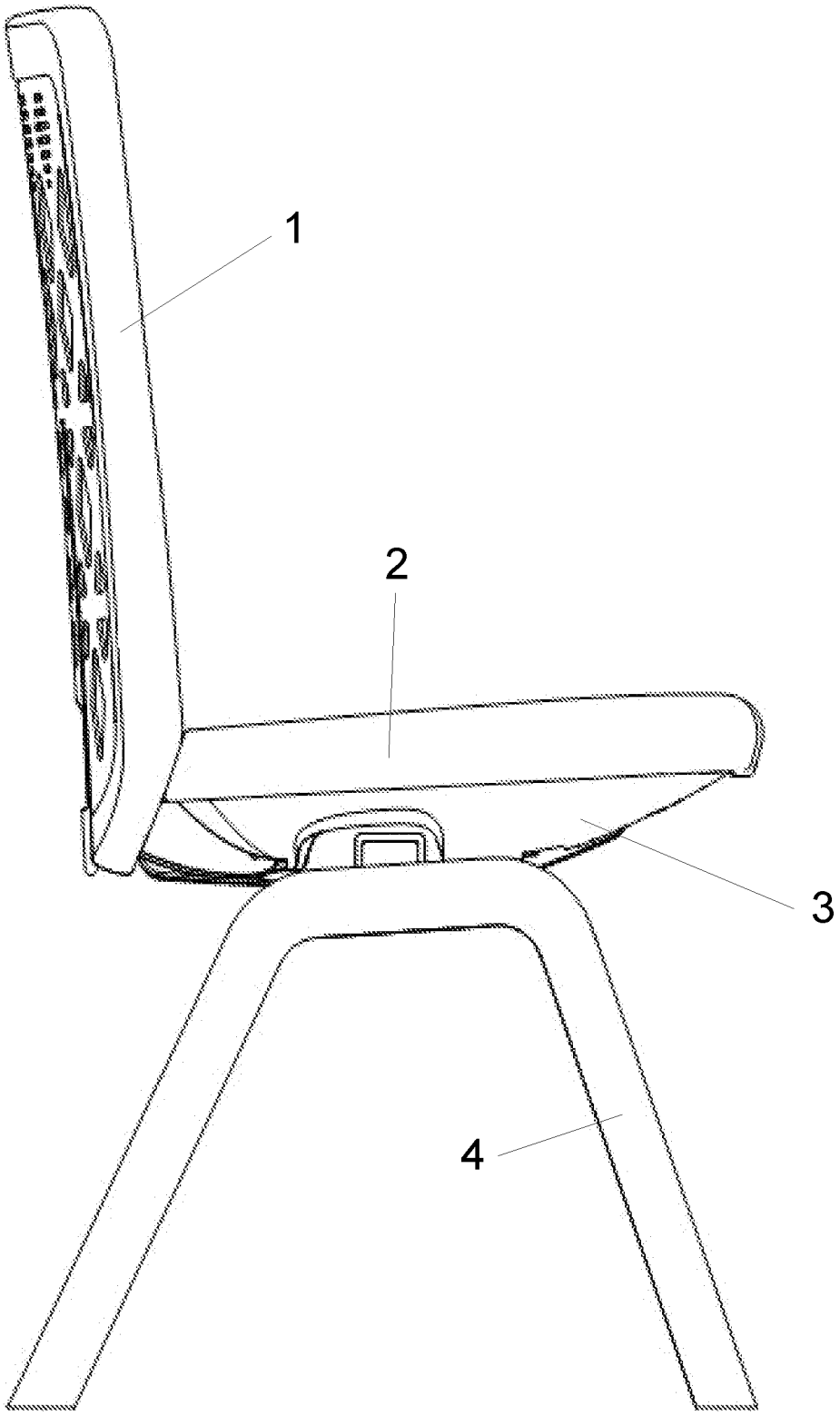
FIGS. 1*a* and *b* are a side view of a chair incorporating a seat module according to the invention.

In the following, directional indications such as "front", "rear", "upward", "downward", "forward", "backward", "front", "downward projecting" etc., relate to a seat module in its natural position of use shown in the drawings.

Figure 1B:
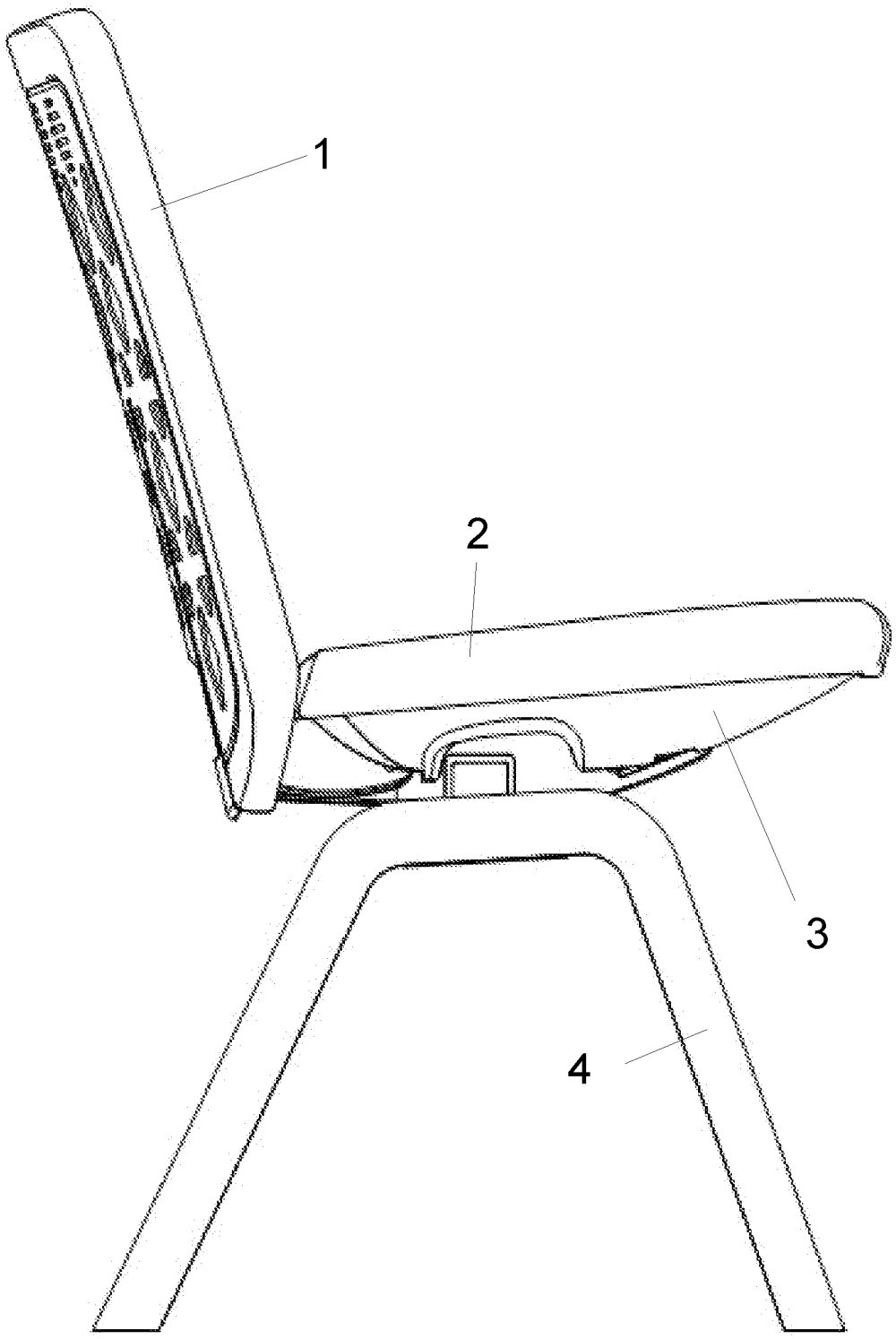

FIGS. 1*a* and 1*b* show a chair incorporating a seat module according to the invention comprising a backrest 1, a seat 2 and a coupling element 3 that holds the backrest and seat together, and further is attaching the backrest and the seat to a support member 4. Multiple seat modules, including backrests, seats and coupling elements, can be put together to form a sofa or a row of seat modules, instead of a chair as shown in the figure. Multiple seat modules can also be attached to a corner element so that they form a corner sofa and the like.

FIG. 1*a* shows the chair with its back in upright position, while FIG. 1*b* shows the chair when the back is angled backwards. The seat is also pushed slightly forward and the front of the seat is raised slightly in relation to the situation in FIG. 1*a*.

Figure 2:
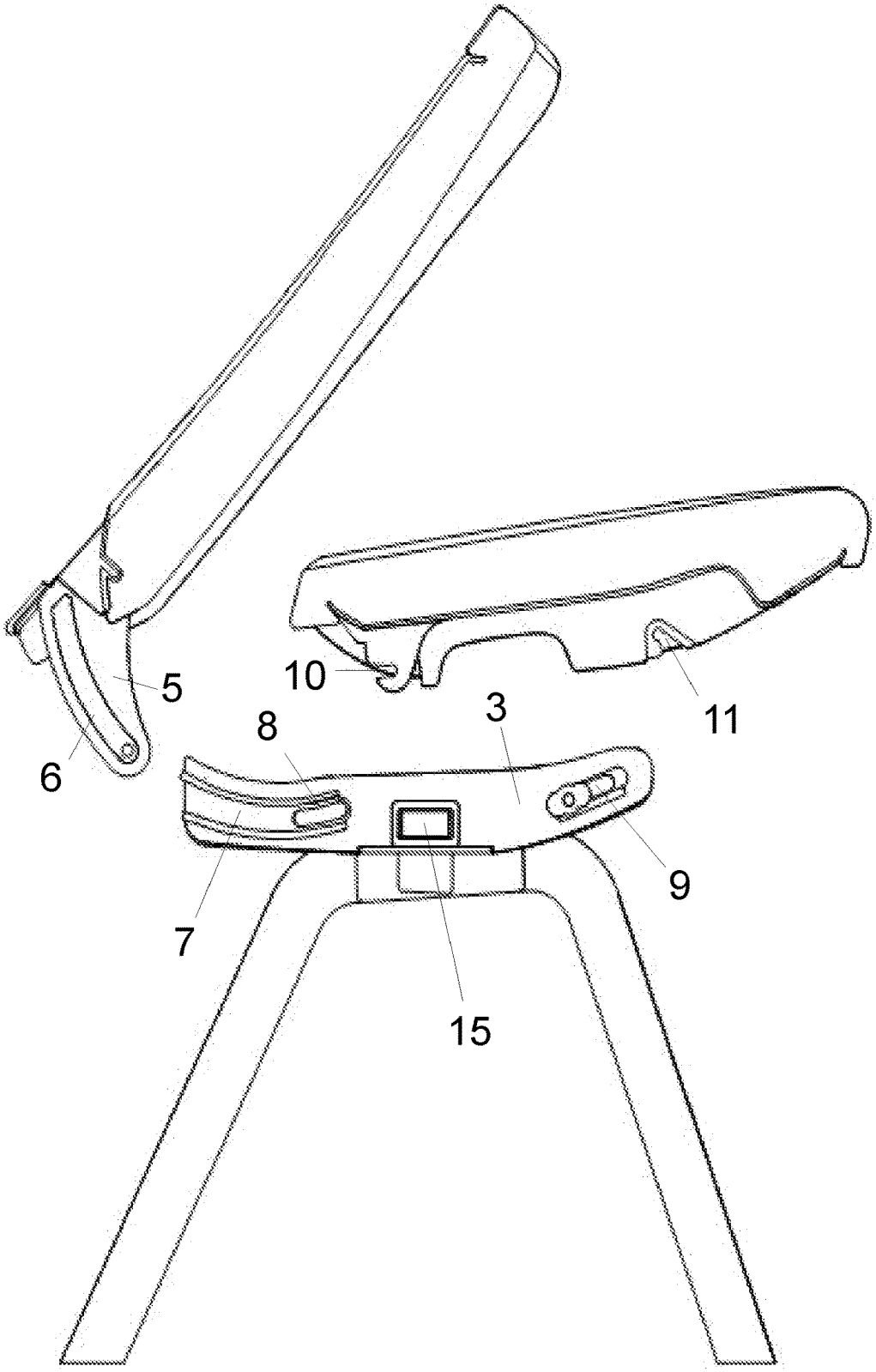
FIG. 2 shows the individual elements included in the chair, in side view.

FIG. 2 shows the seat from the side, as the backrest and seat are loosened from the coupling element to show details of the structure. The coupling element comprises on its two respective sides rear grooves 7 and front grooves 9, the rear grooves being provided as arcuate or radial incisions. The backrest, in turn, comprises brackets 5 with arcuate or radial protrusions 6 adapted to engage the grooves 7 of the coupling element so that the protrusions can slide back and forth in the grooves 7. Thus, the grooves 7 define a turning point and an imaginary hinge point for the backrest 1.

The front grooves 9 are provided as correspondingly directed radial or arcuate through grooves, alternatively linear grooves with pitch toward the front of the seat module. Sliding sleeves or lugs 23 mounted on a slide rod 21 (FIG. 3) run in the grooves 9. The seat is secured to the slide rod by means of first notch 11 in the front lower part of the seat. The sliding sleeves or lugs 23 are mounted on each end of the slide rod 21, the sliding sleeves or lugs engaging respective front grooves 9 on either side of the coupling element 3.

Figure 3:
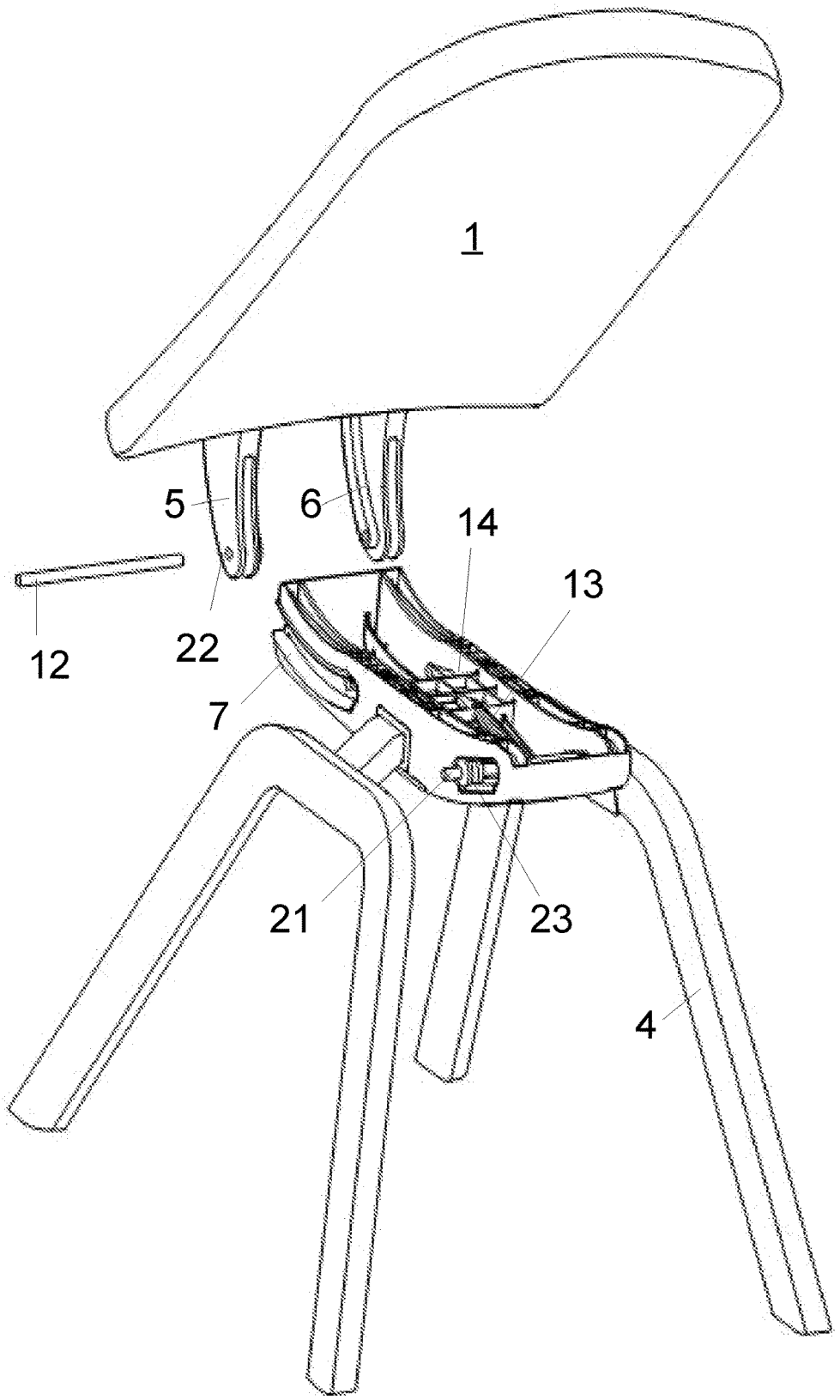
FIG. 3 is a perspective view showing the construction of the chair in more detail.

FIG. 3 shows how the backrest is attached to the coupling element. The brackets 5 at the bottom of the backrest 1 are provided with arcuate projections 6, with the projections of the two brackets facing inwards and towards each other. The protrusions engage the rear grooves 7 and the backrest is locked to the coupling element by means of a locking rod 12 which passes through holes 22 at the end of each bracket and through longitudinal and through-openings 8 in the bottom of the grooves 7. The length of the openings 8 defines the rotational range of the backrest.

When assembling the seat, it is pressed down so that the front notches 11 grip around the slide rod 21. The slide rod 21 is secured with a spring 13 to a cross beam 14 which passes between the side walls of the coupling element 3. Similarly, at the rear end of the seat 2, rear notches 10 are arranged to grip the locking rod 12 (FIG. 2). By pushing the backrest 1 forward into the rear groove 7, the locking rod 12 will be pressed into and locked in the rear notches 10.

The spring 13 serves to straighten the chair back when the user rises from the seat module. If there are more modules in a row, this will ensure a tidy impression when the modules are not in use. The spring has a strength adapted to balance the sliding function of the seat module, and also to ensure proper straightening of the backrest. When the seat is mounted, the spring will also have a bias.

The coupling element 3 is preferably moulded as a single piece of fibre-reinforced plastic composite, although it can of course be manufactured in other suitable polymeric materials or metal, or partly of polymer and partly of metal. Likewise, both the backrest and seat can contain a core of composite or plastic covered with foam, fibre and fabric or skin. Alternatively, the said brackets may consist of metal cast in the backrest.

Figure 4:
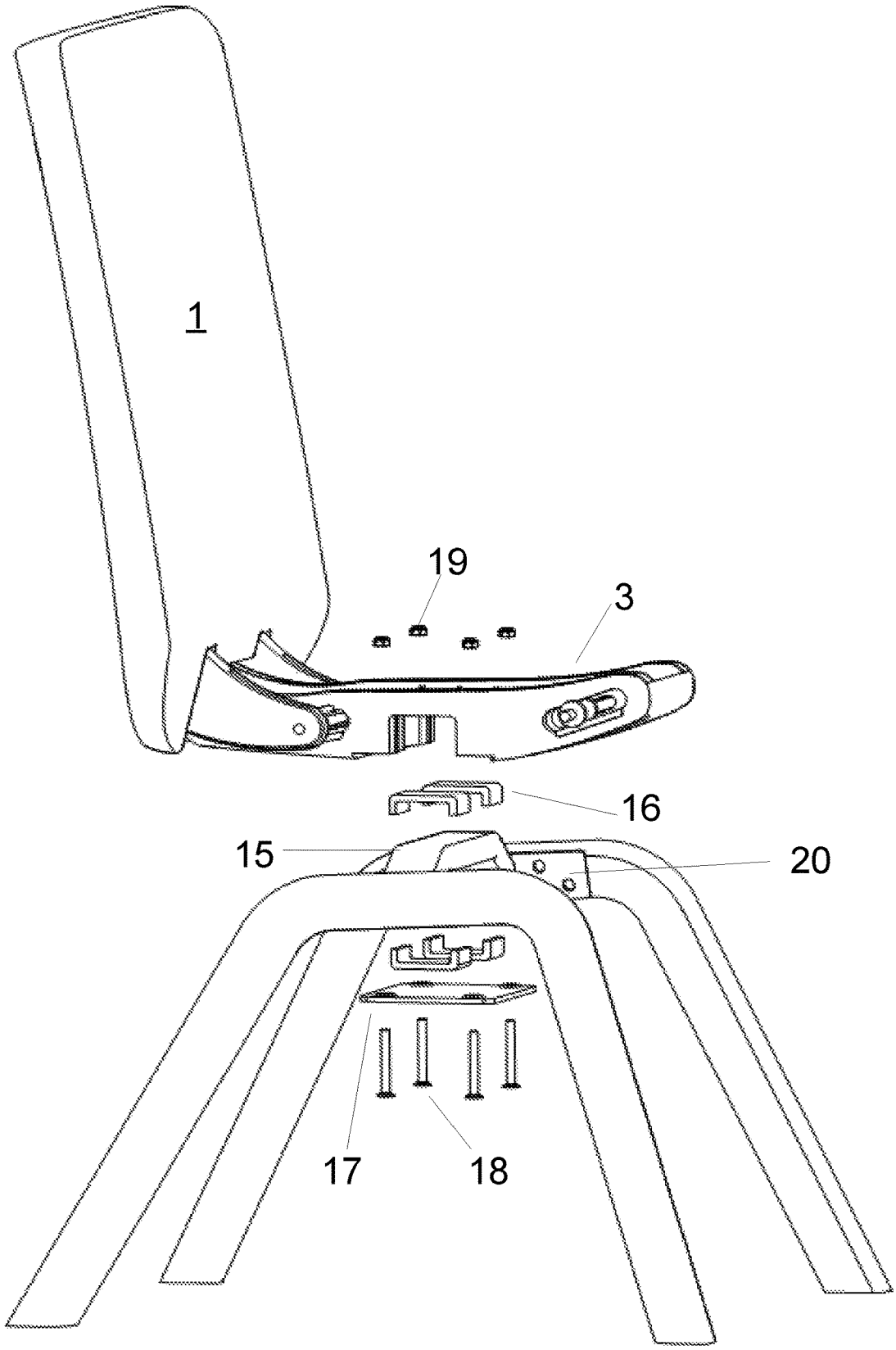
FIG. 4 is a perspective view showing details of a tilting joint included in the invention.

FIG. 4 is an exploded view showing details of the tilt mechanism used in each seat module. The tilt mechanism comprises a central beam 15 which is polygonal in cross section. The central beam is terminated at each end by fixing plates 20. In this case the fixing plates are bolted to legs which form a support member or base 4. Around the central beam 15, there are elastic means 16. In the illustrated case, the beam with the elastic means is raised into a recess in the coupling element 3, the recess forming an opening in the U-shaped cross beam 14 (shown in FIG. 3). The central beam is kept in place by closing the opening of the U-beam with a cover plate 17. The U-shaped cross beam and the cover plate thus form a housing around the central beam and the elastic means. The elastic means allow a rotational movement of the outer housing relative to the central beam. The central beam and cover plate preferably consist of metal, while the elastic means consists of parts manufactured in a suitable resilient material such as rubber or other type of polymer.

As mentioned above, the central beam is polygonal in cross section. From a production viewpoint, it is preferred that the beam be square or rectangular in cross section, but in principle it may have any polygonal shape. In the simplest case, it may be triangular in cross section, but it is also possible to use other shapes such as hexagonal, octagonal, etc.

In the case shown, the cover plate is attached with bolts (machine screws) 18 and nuts 19. Alternatively, the nuts can be replaced by a fixing plate located on top of the central beam, with threaded holes being provided in the fixing plate for the bolts 18. In yet another alternative embodiment, instead of through bolts, screws that engage holes in the coupling element are used.

In an alternative embodiment of the tilting mechanism (not shown) an opening is provided in the cover plate and a conical hole in the central beam. The opening is aligned facing the conical hole so that the tilt mechanism can easily be mounted on a chair base of the gas lift type.

The tilting mechanism can in principle also be arranged in the opposite way, i.e. the central beam is attached or included in the coupling element and passes between the longitudinal walls thereof while the housing is attached to the base.

The tilting mechanism shown in FIG. 4 is preferred for use in the shown seat module because it can easily be included as part of the coupling element. However, other types of tilting mechanisms may be used, for example a torsion spring tilting mechanism. Such tilting mechanisms are commonly used in office chairs. However, such a solution will readily comprise several components which must be bolted to the coupling element and a corresponding base complicating the mechanism.

In use, the user can lean backwards and slide the seat forward. The backrest will then slide forward in the grooves arranged in the coupling element so that the back is angled backwards, FIG. 1*b*, while the seat (which is coupled to the backrest) will be pushed forward along the front grooves of the coupling element. As the front tracks are arranged, the seat will also be raised slightly at the leading edge. Once the user has found his preferred position, the seat module setting is stable, even if the user should choose to flip back and forth via the tilting link between seat module and base.

The invention claimed is:

1. A seat module for use in furniture for sitting, the seat module comprising a backrest (1), seat (2) and coupling element (3), the coupling element (3) comprising two side walls held together by transverse elements and further comprising rear grooves (7) arranged in a rear end of the coupling element (3) and front grooves (9) arranged at a forward end of the coupling element (3), the rear and front grooves (7, 9) being arranged in respective sidewalls of the coupling element (3), wherein the backrest (1) comprises brackets (5) adapted to engage and run in said rear grooves (7), wherein a rear portion of the seat (2) is connected to the backrest (1), and wherein a front portion of the seat (2) is connected to a sliding unit (21, 23) running in said front grooves (9), characterized in that the coupling element (3) comprises through-openings (8) located in the rear grooves (7), the seat module further comprising a locking rod (12) adapted to pass through holes (22) in the brackets (5) and through said openings (8) so that the backrest (1) is locked to the coupling element (3), the sliding unit comprises a slide rod (21) with sliding sleeves (23) at each end, the sliding sleeves (23) being adapted to engage said front grooves (9), a spring (13) is secured between a cross beam (14) which passes between the side walls of the coupling element (3) and said slide rod (21), and wherein the seat (2) comprises rear notches (10) adapted to grip the locking rod (12) and front notches (11) adapted to grip the slide rod (21).

2. The seat module of claim 1, wherein the rear grooves (7) are provided as arcuate or radial incisions, said brackets (5) comprising corresponding arcuate or radial protrusions (6) adapted to engage the grooves (7) of the coupling element (3), and wherein the front grooves (9) are provided as radial or arcuate or linear through grooves with a pitch toward the front of the seat module.

* * * * *